United States Patent [19]

Uerpmann

[11] 4,316,814

[45] Feb. 23, 1982

[54] SEAL FOR A STORAGE BORE HOLE ACCOMMODATING RADIOACTIVE WASTE AND METHOD OF APPLYING THE SEAL

[75] Inventor: Ernst-Peter Uerpmann, Brunswick, Fed. Rep. of Germany

[73] Assignee: Gesellschaft fur Strahlen-und Umweltforschung mbH, Neuherberg b. München, Fed. Rep. of Germany

[21] Appl. No.: 72,581

[22] Filed: Sep. 5, 1979

[30] Foreign Application Priority Data

Sep. 13, 1978 [DE] Fed. Rep. of Germany ..... 2839759

[51] Int. Cl.[3] ..... G21F 7/00; G21F 9/24

[52] U.S. Cl. ..... 252/633; 405/128

[58] Field of Search ..... 252/301.1 W; 405/128

[56] References Cited

FOREIGN PATENT DOCUMENTS

| | | | |
|---|---|---|---|
| 2433168 | 1/1976 | Fed. Rep. of Germany | 252/301.1 W |
| 2756634 | 6/1978 | Fed. Rep. of Germany | 252/301.1 W |
| 1297279 | 5/1961 | France | 252/301.1 W |
| 51-12100 | 1/1976 | Japan | 252/301.1 W |
| 7602753 | 9/1977 | Netherlands | 252/301.1 W |
| 1024089 | 3/1966 | United Kingdom | 414/146 |

*Primary Examiner*—Deborah L. Kyle

*Attorney, Agent, or Firm*—Spencer & Kaye

[57] ABSTRACT

A storage arrangement for radioactive waste includes a storage bore hole defined by walls of a rock formation, vessels containing radioactive waste deposited in a vertical series in the storage bore hole and a sealing closure situated in the storage bore hole above the uppermost vessel. The sealing closure is a prefabricated solid body (or several such bodies in a vertical series) closely conforming, along its circumference, to the shaft walls.

4 Claims, 1 Drawing Figure

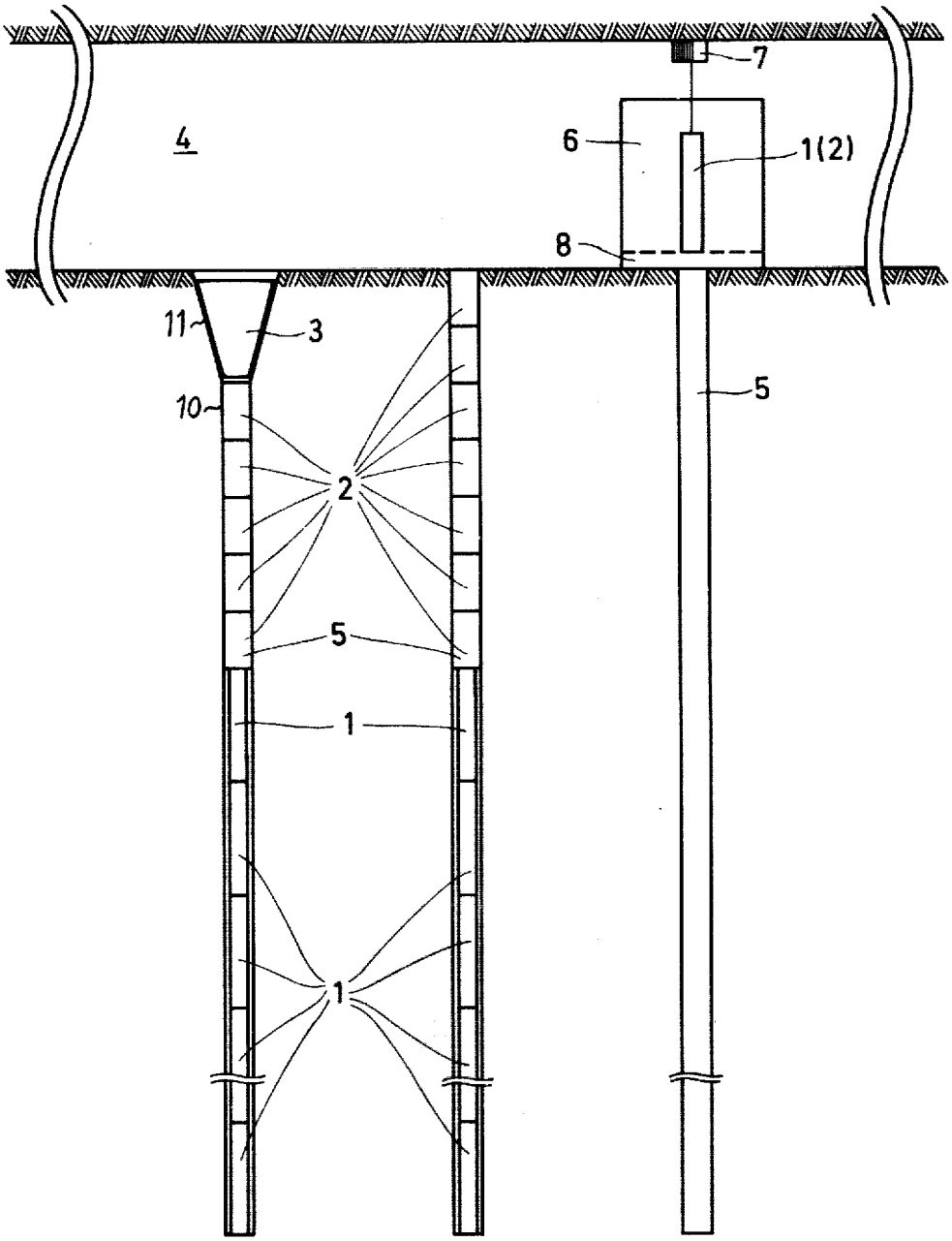
7
4
6
1(2)
8
11
3
10
5
2
5
1
1

SEAL FOR A STORAGE BORE HOLE ACCOMMODATING RADIOACTIVE WASTE AND METHOD OF APPLYING THE SEAL

BACKGROUND OF THE INVENTION

This invention relates to closures for sealing storage bore holes which constitute the final disposal site of radioactive waste and a method of applying the closures.

For disposing of highly radioactive waste obtained in the reprocessing of irradiated nuclear fuel, the waste is mixed with glass-forming materials and is melted to form a glass mass which is loaded in vessels made of a high-quality steel and is allowed to harden therein. The decay energy of the radioactive fission products is sufficient to heat the steel vessels beyond the ambient temperature during a period of approximately 30 to 50 years. Dependent upon the concentration and the age of the fission products, the generated initial temperatures may be several hundred degrees Centigrade. Governmental disposal projects in the Federal Republic of Germany provide for a final storage of such highly radioactive waste in rock salt formations after an intermediate storage of 5 to 10 years. For such a final disposal, the waste is introduced into vertical storage bore holes having a depth of 20 to 50 m. These bore holes have to be provided with an appropriate seal at the top.

Heretofore, essentially two methods have been suggested concerning the provision of such sealing closures:

(1) The highly radioactive waste is to be covered with ground salt. This method is noted in a paper entitled "Bericht über das in der Bundesrepublik Deutschland geplante Entsorgungszentrum für ausgediente Brennelemente aus Kernkraftwerken" (Report on the Proposed Disposal Center in the Federal Republic of Germany for Fuel Elements Used Up in Nuclear Power Plants), December 1976, page 86.

(2) A salt solution-resistant cement is poured over the highly radioactive waste. This method is noted in a dissertation by R. Proske, entitled "Beiträge zur Risikoanalyse eines hypothetischen Endlagers für hochaktive Abfälle" (Contributions to the Risk Analysis of a Hypothetical Final Disposal Site for Highly Radioactive Waste), 1977, page 17.

The first method provides no hermetic closure if, as hypothetically presented in the report, water break-in occurs in the pit wall. In such a case the heat-generating waste would directly contact the salt solutions and the possibility of a contamination of the salt solutions by wash-out activity is not excluded. The heat sources induce a convection of the salt solutions which may lead to an entrainment of the radioactivity over wide areas.

If, as noted in the second method, the storage bore holes are sealed by cement, a number of problems remain unresolved. Thus, for example, upon pouring in the dough-like cement, perspiration water or excess water may contact the waste vessels as such water runs down the inner walls of the storage bore hole. This water is, by the $\gamma$-radiation, decomposed radiologically among others, into $H_2$ and $O_2$ (oxyhydrogen). In addition, OH radicals and $H_2O_2$ are formed which are strongly corrosive. Further, by the strong $\gamma$-radiation, the water bound in the cement is also in part radiologically split, resulting in a radiation-caused damage to the cement. The radiation-resistance of the cement is approximately $10^{10}$ rad. Tests conducted with electrically heated sample waste vessels have shown that particularly the upper part of the storage bore holes undergo a significant constriction in cross section. The continuous contraction of the storage bore hole could conceivably affect the binding and hardening process of the cement to such an extent that a sufficient final strength of the closure arrangement is not obtained.

SUMMARY OF THE INVENTION

It is an object of the invention to provide an improved sealing closure for the above-discussed purpose which is radiation-resistant, pressure-resistant, corrosion-resistant, thermally stable and which can be manufactured and handled in a simple manner. Further, the closure should be adapted to absorb compression stresses derived from the heat expansion of the rock and should enter into a mechanically tight connection with the salt formation in which the storage bore hole is provided and should be adapted for installation under full protection from radiation.

These objects and others to become apparent as the specification progresses, are accomplished by the invention, according to which, briefly stated, the sealing closure is formed of at least one prefabricated body which is a metal and/or a dense ceramic material and/or cast steel and/or a lead alloy and which is arranged in the storage bore hole above the uppermost waste vessel in a close fit with respect to the bore hole wall.

The particularly novel and inventive solution is seen in the arrangement of prefabricated closure elements which may be manufactured with uniform standards in quality. Thus, extensive work in the vicinity of the storage bore holes may be dispensed with. The personnel is not exposed to any radiation, since the sealing closures can be introduced into the storage bore holes by remote control. The proposed materials for the closure contain no water which could otherwise be decomposed radiologically by a $\gamma$-radiation. Since the above-noted materials from which the sealing closures may be made are conventionally used as shielding materials (lead alloys and cast steel) or as a reactor building material (ceramic), their resistance to radiation is superior. The thermostability of these materials is also of a superior degree; lead alloys will not melt under the conditions to be expected and the pressure resistance of ceramic and cast steel is sufficiently high for this purpose. Further, lead alloys are particularly advantageous, since they are adapted to be deformed in a ductile manner and therefore provide an excellent seal. The handling of prefabricated bodies by remote control can be effected without difficulty. Cast steel is, similar to lead, a corrosion-resistant material. Dense ceramic is highly corrosion resistant and is widely used for conduits in chemical laboratories.

In summary, the particular advantages of the invention are to be regarded in the configurational uniformity of the sealing closures, in a high degree of safety during installation and in the lack of water content in the material of the sealing bodies. All methods wherein the storage bore holes are filled either with ground salt or with cement require the presence of personnel in the vicinity of non-sealed storage bore holes. The quality of the storage bore hole closure can vary in these known methods and cannot be checked because of the exposure to large doses of radiation.

BRIEF DESCRIPTION OF THE DRAWING

The sole FIGURE illustrates in longitudinal section several vertical storage bore holes incorporating a preferred embodiment of the invention.

DESCRIPTION OF THE PREFERRED EMBODIMENT

Turning now to the FIGURE, there is shown an underground transverse tunnel 4 from which extend vertical storage bore holes 5. Of the three storage bore holes 5 shown, the two right-hand bore holes have a circular cross-sectional area throughout, while the left-hand storage bore hole has at its upper terminus a conical enlargement 11. Cylindrical waste containers 1 and then sealing bodies 2 and/or 3 can be lowered into the bore holes 5 by means of a displaceable crane 7. The latter is situated at least in part in a shielding vessel 6 provided with a radiation protective slide 8 oriented towards the floor of the tunnel 4 and thus towards the storage bore holes 5. The shielding container 6 is movable as a unit with the crane 7 and is mounted on a trolley, not shown. The shielding screen 6 provides protection against radiation from the storage bore holes as the waste containers are deposited thereinto.

The storage bore holes 5 are filled with the waste containers 1 only up to a predetermined height. The sealing closure is formed in each instance by one or a plurality of bodies 2 whose outer surface fits into the wall 10 of the storage bore holes 5. For a better adherence and sealing relationship with respect to the salt formation, the outer surface of the bodies 2 may have a smooth, coarse, fluted or wavy outer surface. In case the storage bore hole 5 has an upwardly flaring conical end portion 11, the sealing body 3 has a conforming conical shape.

The material of the bodies 2 or 3 may be metal, ceramic, cast steel, a lead alloy or an alkali-resistant material, such as bitumen charged with solids to obtain a density of at least 1.40 g/cm$^3$.

It is to be understood that the above description of the present invention is susceptible to various modifications, changes and adaptations, and the same are intended to be comprehended within the meaning and range of equivalents of the appended claims.

What is claimed is:

1. In a storage arrangement for radioactive waste, including a storage bore hole defined by walls of a rock formation, vessels containing radioactive waste deposited in a vertical series in the storage bore hole and a sealing closure situated in the storage bore hole above the uppermost vessel, the improvement wherein said sealing closure includes a prefabricated solid body of alkali-resistant charged bitumen closely conforming, along its circumference, to said walls; said charged bitumen having a density of at least 1.40 g/cm$^3$.

2. A storage arrangement as defined in claim 1, wherein the upper terminal portion of said storage bore hole has an upwardly widening conical shape; said body being arranged in said upper terminal portion and having a conical shape conforming to the configuration of said upper terminal portion.

3. In a method of storing radioactive waste in a storage bore hole, including the step of lowering vessels containing radioactive waste into the storage bore hole; the improvement comprising the step of closely fitting a prefabricated body of alkali-resistant charged bitumen into the storage bore hole above the uppermost vessel; said charged bitumen having a density of at least 1.40 g/cm$^3$.

4. A method as defined in claim 3, wherein the fitting step includes the step of lowering said body into said storage bore hole by a crane onto the uppermost vessel through a shielding screen having an anti-radiation slide at its bottom.

* * * * *